United States Patent [19]

Slack

[11] Patent Number: 4,632,301

[45] Date of Patent: Dec. 30, 1986

[54] STORAGE CONTAINER BLANK

[75] Inventor: Donald H. Slack, Highland Park, Ill.

[73] Assignee: Lincoln Packaging Corp., Highland Park, Ill.

[21] Appl. No.: 737,694

[22] Filed: May 28, 1985

[51] Int. Cl.[4] ..... B65D 5/24

[52] U.S. Cl. ..... 206/292; 206/45.31; 229/145; 229/181

[58] Field of Search ..... 229/31 FS, 33, 36; 206/45.31; 220/256

[56] References Cited

U.S. PATENT DOCUMENTS

| | | | |
|---|---|---|---|
| 2,913,967 | 11/1959 | Scriven Jr. | 229/31 FS |
| 3,048,316 | 8/1960 | Roos et al. | 206/45.31 |
| 3,355,085 | 11/1967 | Lindstrom | 229/31 FS |
| 4,042,143 | 8/1977 | Biggins | 220/256 |
| 4,171,061 | 10/1979 | Burroughs et al. | 220/256 |
| 4,390,111 | 6/1983 | Robbins et al. | 220/256 |

FOREIGN PATENT DOCUMENTS

| | | | |
|---|---|---|---|
| 537886 | 3/1957 | Canada | 229/31 FS |
| 578309 | 6/1959 | Canada | 229/31 FS |

*Primary Examiner*—Joseph Man-fu Moy
*Attorney, Agent, or Firm*—Dick and Harris

[57] ABSTRACT

A storage container blank for articulation into a wedding gown box container for the long term storage of gowns in a manner which prevents the entry of dust and other contaminants into the container, thus preserving the gown. A series of operably joined panels form a lower storage container cavity and an additional series of integrated operably joined panels form an upper storage container cover capable of telescopically covering the cavity upon articulation. The lower storage container cavity includes integrated contaminant barrier elements to preclude the entry of dust and other contaminants therewithin. In one embodiment an inspection insert panel is preliminarily placed over the gown within the lower storage container cavity before positioning of the upper storage container cover portion over the lower storage container cavity to enclose same.

13 Claims, 8 Drawing Figures

STORAGE CONTAINER BLANK

BACKGROUND OF THE INVENTION

The present invention relates generally to storage container apparata and in particular to a storage container blank for articulation into a wedding gown storage container box for the long term storage of gowns in a manner which prevents the entry of dust and other contaminants into the storage container thus preserving the gown.

Over the years, a number of apparata have been addressed to the storing of wedding gowns for future use or as keepsakes. Users of such prior art storage apparata have typically stored their valuable gowns in such containers for the purpose of preserving it in a condition as close to its original state for decades in the future. Unfortunately however, many of such prior art storage apparata have experienced drawbacks which have on occasion resulted in spoilage and deterioration of the stored gown over a considerable period of time. These prior art devices employed the use of open corner segments in the formation of the storage box. Gaps at these corners have often permitted dust and other contaminants to enter into the storage container which would contact the gown and cause such deterioration over time. Additionally, these prior art devices occasionally employed inspection insert panels whereby the contents of the container could be viewed through transparent material covering an opening in the insert panel. Indeed, because of the fragile nature of many fabrics and their susceptibility to spoilage from contaminants, the garment would be cleaned after use, prior to its being placed into storage. Containers that relied on the utilization of adhesive tape applied towards sealing their corners occasionally suffered from this same flaw as the tape could deteriorate over time, exposing the open corners and contaminant inlets, so as to permit the gown within to spoil.

Accordingly, it is an object of the present invention to provide a storage container blank for articulation into a wedding gown box container for the long term storage of gowns in a manner which prevents the entry of dust and other contaminants into the container thus more effectively preserving the gown for future use or retention.

It is additionally an object of the present invention to provide such a storage container which is formed by the articulation of integrated continuous panel members which provide improved structural rigidity and integrity for the overall container through the overlapping and interlocking of such panel members while providing such a contaminant barrier.

It is a further object of the present invention to provide such a storage container which utilizes integrated and substantially continuous corner elements to provide a contaminant barrier to achieve effective protection of the gown stored within. In so doing, it is an object of the invention to have such corner elements also serve to add structural integrity to the storage container through the compression, articulation and positioning of said corner elements obviating the need for the application of adhesive tape or glue to form box corners or to preserve the dust resistance of the lower storage container cavity.

The compression of the corner elements eliminates the bulk that would otherwise exist in the sides of the storage container while the particular articulation and positioning provides structural integrity for the storage container. Additionally, such corner elements are integrated into the storage container blank and are formed to facilitate their articulation, eliminating the need to add further attachments and permitting quick and easy assembly of the storage container.

It is yet another object of the invention to provide such a storage container which includes an inspection insert through which the contents of the container may be viewed without affecting the integrity of the dust resistance characteristics of the storage container, with such inspection insert containing a transparent plastic window permitting the viewing of the gown.

As a further object, the present invention provides for a storage container constructed by the articulation of multiple panel members which are formed from a substantially continuous sheet of material providing for ease of manufacture, storage and assembly resulting in a cost savings and a corresponding increase in protection from the entry of dust and other contaminants.

These and other objects of the invention will become apparent in light of the present specification and drawings.

SUMMARY OF THE INVENTION

The present invention comprises a storage container blank for articulation into a wedding gown box container for the long-term storage of wedding gowns and other apparel in a manner which prevents the entry of dust and other contaminants into the container so as to preserve the enclosed garment within the container.

The container blank itself comprises lower panel means as well as bottom lower side panel means operably attached for articulation to the bottom side of the lower panel means along a substantially continuous bottom lower side panel fold edge. First lower side panel means are operably attached for equivalent articulation to a first side of the lower panel means along the equivalent substantially continuous first lower side panel fold edge and second lower side panel means are operably attached for articulation to a second side of the lower panel means along a substantially continuous second lower side panel fold edge. The first lower side panel means is substantially opposite to the position of the second lower side panel means along the lower panel means. Connection panel means are operably attached for articulation to the top of the lower panel means along an equivalent substantially continuous lower connection panel fold edge, with said lower panel means, said bottom lower side panel means, said first lower side panel means, said connection panel means and said second lower side panel means collectively articulatable into a lower storage container cavity.

The storage container blank further comprises an upper storage container cover portion, operably attached to the lower storage container cavity, so as to enable telescopic receipt by said cover means of the structure formed through said lower storage container cavity. Particularly, the upper storage container cover includes upper panel means which are operably attached for articulation to the top of the connection panel means along a substantially continuous upper connection panel fold edge as well as top upper side panel means operably attached for articulation to the top of the upper panel means along an equivalent continuous top upper side panel fold edge. A first upper side panel means is operably attached within said upper storage container cover means for articulation along the first side of the upper panel means, again, along a continuous first upper side panel fold edge. A second upper side panel means is additionally operably attached for articulation to a second side of the upper panel means along a substantially continuous second upper side panel fold edge in a configuration with the first upper side panel means being substantially opposite the second upper side panel means along the upper panel means.

One or more contaminant barrier means are operably interposed for articulation within the lower storage container cavity and specifically positioned between one or more of the bottom lower side panel means, the first lower side panel means, the connection panel means and the second lower side panel means. These contaminant barriers operably seal the juxtaposed vertically orientated regions respectively created among these elements of the lower storage container cavity, upon articulation of the bottom lower side panel means, first lower side panel means, connection panel means and/or said second lower side panel means structures. The result is to preclude migration of dust dirt and other contaminants into the lower storage container cavity upon articulation of same from said container blank.

The preferred embodiment of the invention further includes additional panel means for securing the contaminant barrier means juxtaposed against one of the side panel means adding strength and rigidity to the lower storage container cavity. A bottom lower edge panel means is operably attached for articulation to the bottom side of said bottom lower side panel means along the substantially continuous bottom lower edge panel fold edge. A first lower edge panel means is similarly attached for articulation to the first side of said first lower side panel means along a substantially continuous first lower edge panel means. A second lower edge panel means is also operably attached for similar articulation to the second side of said second lower side panel means along a substantially continuous second lower edge panel fold edge. In this preferred embodiment, the first lower edge panel means is substantially opposite said second lower edge panel means along said lower panel means.

The corner locking means equivalently comprises a top upper edge panel means operably attached for articulation to the top upper side panel means along the substantially continuous top upper edge panel fold edge. A first upper edge panel means is similarly attached for articulation to the first side of said first upper side panel means along a substantially continuous first upper edge panel fold edge and a second upper edge panel means is similarly attached for similar articulation to the second side of said second upper side panel means along a substantially continuous second upper edge panel fold edge. In the preferred embodiment the first upper edge means is substantially opposite said second upper edge panel means along the upper panel means.

In one embodiment, a bottom lower interlocking panel means is operably attached for articulation to the bottom of the said bottom lower edge panel means along a substantially continuous bottom lower interlocking panel fold edge. Similarly a first lower interlocking panel means is operably attached for articulation of the first side of said first lower edge panel means and similarly a second lower interlocking panel means is similarly attached for articulation to the second side of said second lower edge panel means. In this embodiment the first lower interlocking panel means is substantially opposite the second lower interlocking panel means.

Equivalently, in the cover portion, a top interlocking panel means is operably attached for articulation to the top side of said top upper edge panel means along a substantially continuous top upper interlocking panel fold edge. Additionally, a first upper interlocking panel means is similarly attached for articulation to the first side of said first upper edge panel means along a substantially continuous first upper interlocking panel fold edge and a second upper interlocking panel means is operably attached for similar articulation to the second side of said second upper edge panel means along a substantially continuous second upper interlocking panel fold edge. Additionally in the preferred embodiment said first upper interlocking panel means is substantially opposite said second upper interlocking panel means. In this preferred embodiment one or more corner tab means are operably attached at the outer edges of said top upper side panel means for articulation and connection with adjacent upper side panel means to form rigid sides for the upper storage container cover.

Additionally, the bottom lower interlocking panel means, first lower interlocking panel means and second lower interlocking panel means are articulated into a position overlapping the bottom lower side panel means, first lower side panel means and second lower side panel means respectively, resulting in the formation of a space between corresponding lower interlocking panel means and lower side panel means. This space is measured by the width of the corresponding lower edge panel means which is operably attached between said lower side panel means and lower interlocking panel means. This space is capable of accepting the interposition of said contaminant barrier means so as to lock the articulated contaminant barrier means between respective adjoining panels of said lower storage container cavity together, thus forming a substantially rigid structure while at the same time preserving the dust imperviousness feature of the storage container means.

In this preferred embodiment also, the top upper interlocking panel means, first upper interlocking panel means and second upper interlocking panel means are articulated into a position overlapping said top upper side panel means, first upper side panel means and second upper side panel means respectively, resulting in the formation of a space between corresponding upper interlocking panel means and upper side panel means. This space is measured by the width of the corresponding upper edge panel means. This space is capable of accepting the interposition of said corner tab means so as to facilitate the locking of the articulated panels of the upper storage container cover together so as to form a substantially rigid structure.

The contaminant barrier means of the preferred embodiment comprises a collapsible articulated flap member with each of the flap members being diagnally scored to form multiple angular articulatable sections. The scoring is done only on the upper surface of the blank that faces inwardly of the lower storage container cavity with said scoring not penetrating through the material. This construction permits easy articulation without providing an entry point where dust and other contaminants could enter into said storage container. This scoring permits the contaminant barrier means to fold inwardly toward the interior of said storage container means as said lower side panel means and said connection panel means are raised into a position substantially perpendicular to the plane formed by said lower panel means.

Preferably, the articulate barrier flap members are crushed to substantially one half of the thickness of the material forming the upper and lower side panel means and said upper and lower interlocking means. This permits the articulated angular sections of said contaminant barrier means to be interposed into the space formed by the overlap of corresponding lower side panel means and lower interlocking panel means. The interposition forms a corner between adjacent lower side panel means and connection panel means resulting in a substantially continuous unbroken surface at said corner positions thus preventing the migration of dust and other contaminants into the storage container.

In the preferred embodiment, a plurality of adhesive stick-pad means are operably attached to said bottom lower interlocking panel means, first lower interlocking panel means, second lower interlocking panel means, top upper interlocking panel means, first upper interlocking panel means and second upper interlocking panel means for the purpose of securing the interlocking panel means in their overlapped orientation to the corresponding side panel means. This further secures said collapsible articulated flap members between said lower interlocking panel means and lower side panel means and secures the corner tab means between said upper interlocking panel means and upper side panel means.

In one embodiment of the invention, the first and second edges of the bottom lower interlocking panel means and the upper and lower edges of said first and second lower interlocking panel means are notched to facilitate the interlocking with adjacent lower interlocking panel means. This interlocking secures the collapsible articulated flap members which have been interposed into the space formed by the overlap of said lower interlocking panel means and lower side panel means. Additionally, the first and second edges of the top upper interlocking panel means and the upper and lower edges of said first and second upper interlocking panel means are similarly notched so as to facilitate the interlocking of adjacent upper interlocking panel means to equivalently secure the corner tab means which have been interposed into the space formed by the overlap of said upper interlocking panel means and upper side panel means.

The invention preferably includes an inspection insert means. This inspection insert means comprises an insert panel element which has a hole cut in it of such size and shape so as to permit visual inspection of the contents of said storage container means. This hole is sealed with a transparent material affixed to the interior of the insert panel means to further prevent the entry of dust and other contaminants. The insert panel means includes a bottom window side means operably attached for articulation to the bottom of said window panel means along a substantially continuous bottom window panel fold edge. Additionally, a first window panel side means is operably attached for articulation to the first side of the insert panel means along a substantially continuous first window panel side fold edge. Similarly, a top window panel side means is operably attached for similar articulation to the top side of said insert panel means and a second window panel side means is similarly attached for similar articulation to the second side of said window panel means. The inspection insert is telescopically received by the lower storage container cavity. Furthermore, the inspection insert is secured by the application of an adhesive tape along the seam formed by the meeting of said lower edge panel means and the edges of said window panel means in a manner so as to permit viewing of the contents while at the same time preserving the dust resistance characteristic of the storage container. Preferably a continuous adhesive bead is used to attach the window to so preclude entry of dust and other contaminants.

In the preferred embodiment, the storage container blank means comprising said lower panel means, bottom lower side panel means, first lower side panel means, connection panel means, second lower side panel means, upper panel means, first upper side panel means, top upper side panel means, second upper side panel means, contaminant barrier means, bottom lower edge panel means, first lower edge panel means, second lower edge panel means, top upper edge panel means, first upper edge panel means, second upper edge panel means, bottom lower interlocking panel means, first lower interlocking panel means, second lower interlocking panel means, top upper interlocking panel means, first upper interlocking panel means, second upper interlocking panel means and said corner tab means are all formed of a single substantially continuous sheet of material with said fold edges consisting of creases being impressed into the sheet where panel means join one another to permit articulation of said panel means into said storage container means. Preferably, additionally, this sheet comprises a corrugated type cardboard material, specifically designed for packaging and containment applications.

DETAILED DESCRIPTION OF THE DRAWINGS

Figure 1:
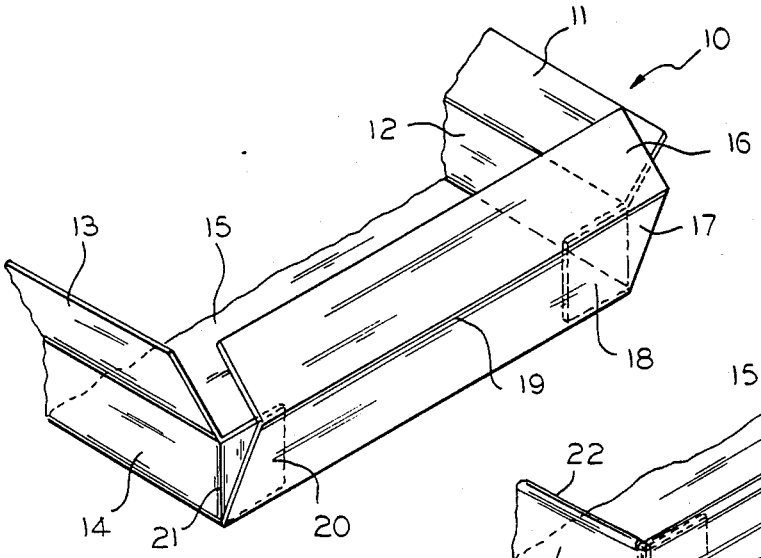
FIG.1 (PRIOR ART)
FIG. 1 of the drawings is a perspective view of the container construction utilized in the prior art, with conventional non-barrier corner elements, particularly showing conventional panel members being articulated so as to form the sides and corners of the container.

While this invention is susceptible of embodiment in many different forms, there is shown in the drawings and will herein be described in detail, one specific embodiment, with the understanding that the present disclosure is to be considered as an exemplifcation of the principals of the invention and is not intended to limit the invention to the embodiment illustratd.

Figure 2:
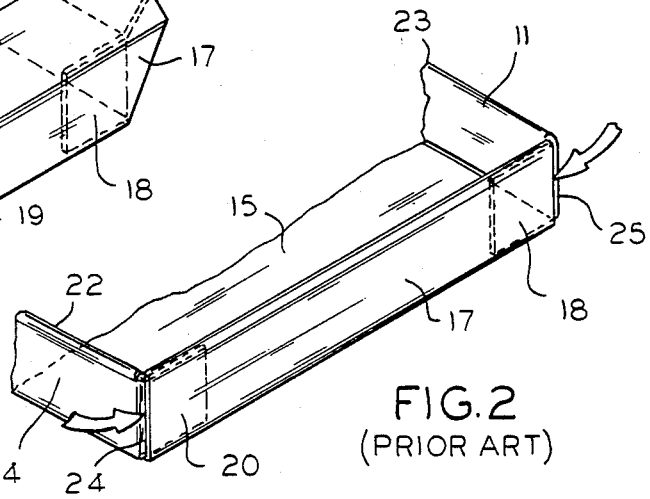
FIG.2 (PRIOR ART)
FIG. 2 of the drawings is a perspective view of the prior art container of FIG. 1 illustrating further articulation of its panels, with arrows indicating entry points where dust and other contaminants can penetrate such a prior art assembly.

FIG. 1 and FIG. 2 set forth the prior art that has been used in association with storage container means, specifically the formation of corner assemblies from storage container blanks. FIG. 1 shows lower panel 15 and the attached side panels 12, 14 and 17. Corner tabs 18 and 20 are attached to opposite side panels 12 and 14 respectively. Corner tabs 18 and 20 are folded inward toward the interior of the storage container. Interlocking panels 11, 13 and 16 are attached to side panels 12, 14 and 17 respectively. These interlocking panels are articulated into a position toward the interior of the storage container overlapping their respective side panels. Side panel 16 however, overlaps corner tabs 18 and 20 as well as side panel 17. As a result, corner tabs 18 and 20 are inserted into the space formed by the overlap of side panel 17 and interlocking panel 16. This combination and articulation of panels forms the corner of such prior art storage containers.

The assembled panels of the prior art container which form the corners of said storage container are illustrated in FIG. 2. Through the insertion of corner tabs 18 and 20 into the space formed by the overlap of interlocking panel 16 and side panel 17 an open space is formed at each corner. Said space is designated as 24 and 25. As such, dust and other foreign contaminants can easily find their way into the storage container through the direct path left open at the corners between the corner tabs 18 and 20 and the juxtaposed side panel 17 as the arrows indicate.

Figure 3:
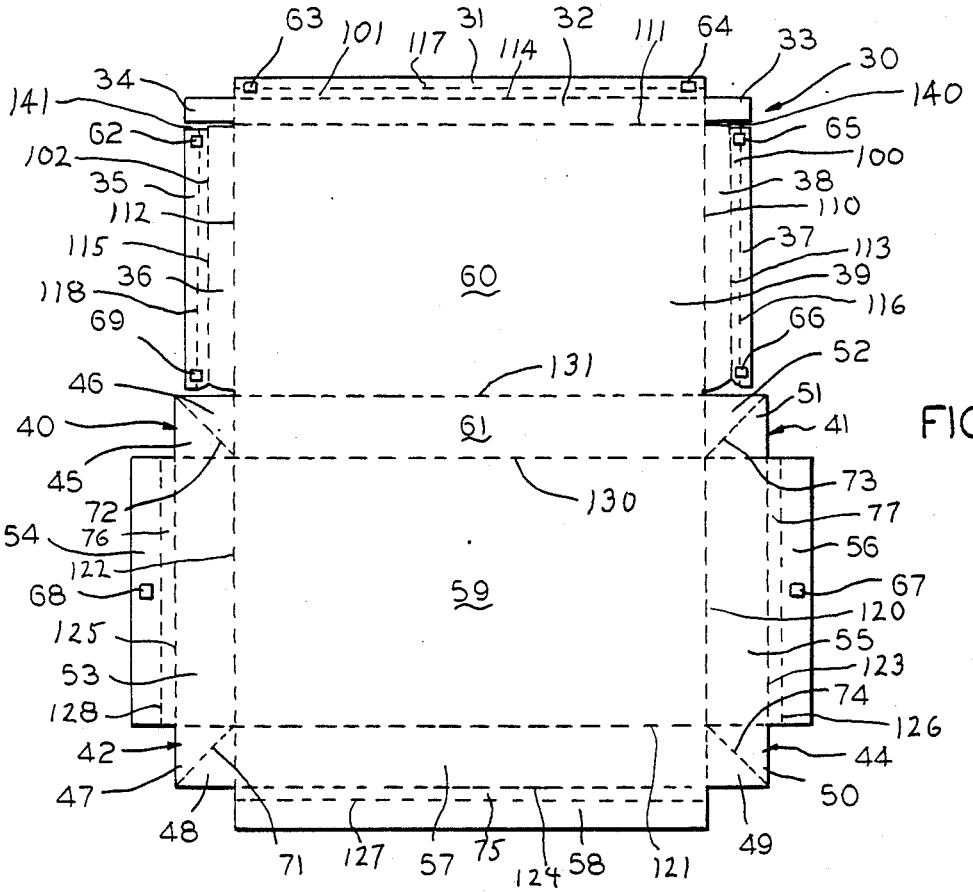
FIG. 3 is a top elevational view of the unassembled storage container blank means of the present invention in which the panel members of the upper storage container cover and lower storage container cavity are shown together with fold edges therebetween.

In FIG. 3 is shown a complete storage container blank formed from a single substantially continuous sheet of material comprising the panels needed to form both the bottom storage container cavity and upper storage container cover.

Lower panel 59 forms the bottom of the storage container cavity. Attached to the second side of lower panel 59 is the second lower side panel 55 attached along a continuous second lower side panel fold edge 120. The bottom lower side panel 57 is attached to the lower panel 59 along the bottom lower side panel fold edge 121 and the first lower side panel 53 is attached to the lower panel 59 along the first lower side panel fold edge 122. The connection panel 61 is attached to the lower panel 59 along the lower connection panel fold edge 130.

Attached between connection panel 61 and adjacent second lower side panel 55 is contaminant barrier 41. This contaminant barrier 41 is composed of two collapsible articulated flap members. Contaminant barrier 41 is diagnally scored on the interior surface of the storage container only with said scoring not penetrating through the material, indicated by line 73. This scoring forms multiple angular sections 51 and 52.

Attached between second lower side panel 55 and adjacent bottom lower side panel 57 is a contaminant barrier 44 formed by two collapsible articulated flap members. Contaminant barrier 44 is diagnally scored on the interior surface of the storage container only with said scoring not penetrating through the material, indicated by line 74. This scoring forms multiple angular sections 49 and 50.

Attached between bottom lower side panel 57 and adjacent first lower side panel 53 is located a contaminant barrier 42 formed by two collapsible articulated flap members. Contaminant barrier 42 is diagnally scored on the interior surface of the storage container only with said scoring not penetrating through the material, as indicated by line 71. Said scoring forms multiple angular sections 47 and 48.

Between first lower side panel 53 and adjacent connection panel 61 is located a contaminant barrier 40 formed by two collapsible articulated flap members. Contaminant barrier 40 is scored diagnally on the interior surface of the storage container only with said scoring not penetrating through the material, indicated by line 72. Said scoring forms multiple angular section 45 and 46.

A second lower edge panel 77 is attached to the second lower side panel 55 along the second lower edge panel fold edge 123. A bottom lower edge panel 75 is attched to the bottom lower side panel 57 along a bottom lower edge panel fold edge 124. A first lower edge panel 76 is attached to the first lower side panel 53 along the first lower edge panel fold edge 125.

Attached to the second lower edge panel 77 is a second lower interlocking panel 56 along a second lower interlocking panel fold edge 126. A bottom lower interlocking panel 58 is attached to the bottom lower edge panel 75 along a bottom lower interlocking panel fold edge 127. The first lower interlocking panel 54 is attached to the first lower edge panel 76 along the first lower interlocking panel fold edge 128.

The lower panel 59; connection panel 61; lower edge panels 55, 57, 53; contaminant barriers 41, 44, 42, 43; lower edge panels 77, 75, 76; and lower interlocking panels 56, 58, 54 all cooperate and are articulated to form the bottom storage container cavity of the storage container.

An upper panel 60 forms the top of the cover for the storage container. Upper panel 60 is attached to the connection panel 61 along an upper connection panel fold edge 131. The first upper side panel 36 is attached to the upper panel 60 along the first upper side panel fold edge 112. The top upper side panel 32 is attached to the upper panel 60 along the top upper side panel fold edge 111. The second upper side panel 38 is attached to the upper panel 60 along the second upper side panel fold edge 110. Attached to the first side of the top upper side panel 32 is a corner tab 34 and attached to the second side of the top upper side panel 32 is corner tab 33.

The first upper edge panel 102 is attached to the first upper side panel 36 along the first upper edge panel fold edge 115. The top upper edge panel 101 is attached to the top upper side panel 32 along the top upper edge panel fold edge 114. The second upper edge panel 100 is attached to the second upper edge panel 38 along the second upper edge panel fold edge 113.

The first upper interlocking panel 35 is attached to the first upper edge panel 102 along the first interlocking panel fold edge 118. The top upper interlocking panel 31 is attached to the top upper edge panel 101 along the top upper interlocking panel fold edge 117. The second upper interlocking panel 37 is attached to the second upper edge panel 100 along the second upper interlocking panel fold edge 116.

The aforementioned upper panel 60, upper side panels 32, 36 and 38, corner tabs 33 and 34, upper edge panels 102, 101 and 100 and upper interlocking panels 35, 31 and 37 all cooperate and are articulated to form the upper storage container cover.

Figure 4:
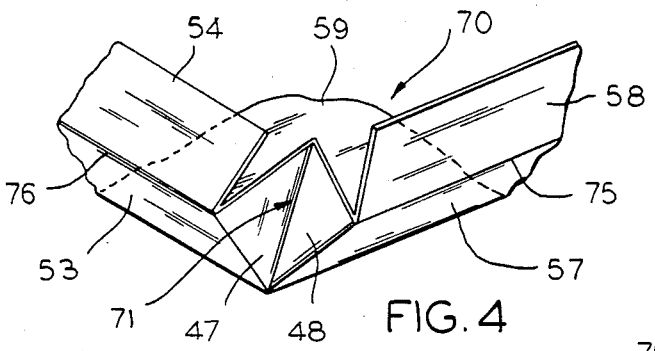
FIG. 4 of the drawings is a perspective view of the contaminant barrier means, specifically the collapsible articulated flap members of the present invention, being articulated into position with said flap members shown folding towards the interior of the storage container cavity.
Figure 5:
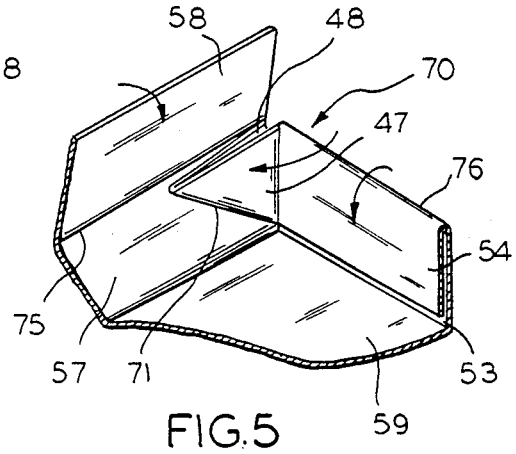
FIG. 5 of the drawings is a perspective view taken from the interior of the storage container showing the collapsible flap contaminant barrier means being positioned in juxtaposed fashion along a side panel.
Figure 6:
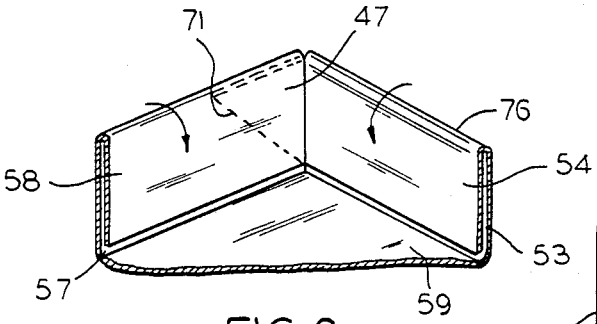
FIG. 6 of the drawings is a perspective view taken from the interior of the storage container cavity, showing the overlap of said interlocking panel means over the side panel means with said contaminant barrier means interposed into the space formed therebetween.

Adhesive stick-pads 62, 63, 64, 65, 66, 67, 68 and 69 are attached as indicated and function to secure overlapped panels as shown in FIGS. 4, 5, and 6.

Notched interlocking panels 140 and 141 exemplify an alternative to the use of adhesive stick-pads for securing overlapped side and interlocking panels. Such notching would be applied to each adjacent interlocking panel edge in both the lower storage container cavity and upper storage container cover permitting adjacent interlocking panels to interconnect and hold fast secured in their articulated positions.

FIGS. 4, 5 and 6 illustrate the articulation of the contaminant barrier and interlocking panels forming a corner of the storage container. FIG. 4 illustrates the articulation of the first lower side panel 53 and bottom lower side panel 57 into a position substantially perpendicular to the lower panel 59. As lower side panels 53 and 57 are raised the contaminant barrier formed by angular sections 47 and 48 is folded toward the interior of the storage container. This folding is made possible by the scoring along line 71.

The contaminant barrier formed by angular sections 47 and 48 completely folded into the interior of the storage container is illustrated in FIG. 5. Once the first lower side panel 53 and bottom lower side panel 57 are fully raised the angular sections 47 and 48, now folded against one another, are juxtaposed to the bottom lower side panel 57. The lower interlocking panel 54 is shown overlapped against the lower side panel 53. As a result, the first lower edge panel 76 is substantially perpendicular to the first lower side panel 53 and first lower interlocking panel 54.

FIG. 6 shows the completed corner of the storage container. The bottom lower interlocking panel 58 is overlapped against the bottom lower side panel 57. This articulation overlaps the juxtaposed angular sections 47 and 48 so as to form a rigid, secure and dust resistant corner. As a result of this articulation there is no direct path through which dust and other contaminants can enter into the storage container since a substantially continuous surface forms the corner of the storage container. The single sided scoring along line 71 preserves the continuous and dust resistant characteristic of this corner assembly.

Figure 7:
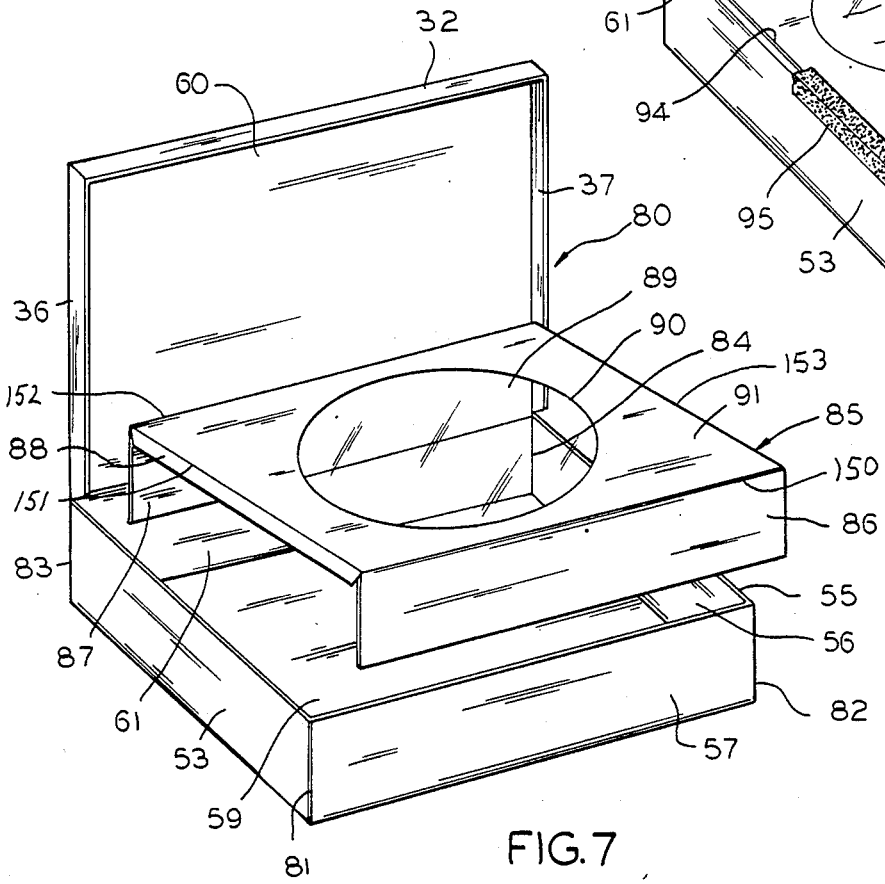
FIG. 7 of the drawings is a front exploded perspective view of the storage container blank upon articulation illustrating the position of the inspection insert means relative to the interior of the storage container cavity.

Inspection insert 80 being received by the lower storage container cavity is illustrated in FIG. 7. The inspection insert 80 is composed of a insert panel 91 having a hole 90 of size and shape to permit visual inspection. The opening 90 in the insert panel 91 is sealed with a transparent material 89 affixed to the under side of said insert panel 91. A bottom window panel side 86 is attached to the insert panel 91 along a bottom window panel fold edge 150. A first widow panel side 88 is attached to the insert panel 91 along a first window panel side fold edge 151. A top window panel side 87 is attached to the insert panel 91 along a top window panel side fold edge 152. A second window panel side 85 is attached to the insert panel 91 along a second window panel fold edge 153. The inspection insert 80 is then telescopically received by the lower storage container cavity. Inspection insert 80 is inserted such that the bottom window panel side 86 is juxtaposed to the bottom lower interlocking panel 58 and that the first window panel side 88 is juxtaposed to the first lower interlocking panel 54, the top window panel side 87 is juxtaposed to the connection panel 61 and that second window panel side 85 is juxtaposed to the second lower interlocking panel 56.

Figure 8:
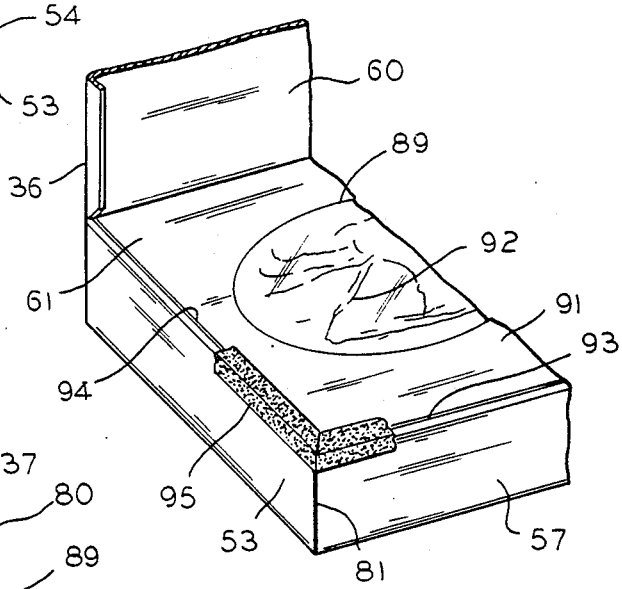
FIG. 8 of the drawings is a front perspective view showing the inspection insert means fully inserted into the storage container cavity after further securement therebetween by adhesive tape sealing means.

FIG. 8 illustrates the inspection insert fully inserted into the lower storage container cavity. The inspection insert is further secured by the application of an adhesive tape 95 along the seams formed by the juxtaposition of the inspection insert so with the interlocking panels and connection panel. The seam between the first window panel side fold edge 151 and first lower edge panel 76 is designated 94 and the seam between the bottom window panel side fold edge 150 and bottom lower side panel 75 is designated 93.

The foregoing description and drawings merely explain and illustrate the invention and the invention is not limited thereto, except insofar as the amended claims are so limited as those skilled in the art who have the disclosure before them will be able to make modifications and variations therein without departing from the scope of the invention.

What is claimed is:

1. A storage container blank for articulation into a wedding gown box container for the long term storage of gowns in a manner which prevents the entry of dust and other contaminants into the storage container thus preserving the gown, said storage container means comprising:

lower panel means;

bottom lower side panel means operably attached for articulation to the bottom of said lower panel means along a substantially continuous bottom lower side panel fold edge;

first lower side panel means operably attached for articulation to a first side of said lower panel means along a substantially continuous first lower side panel fold edge;

second lower side panel means operably attached for articulation to a second side of said lower panel means along a substantially continuous second lower side panel fold edge;

said first lower side panel means being substantially opposite said second lower side panel means along said lower panel means;

connection panel means operably attached for articulation to the top of said lower panel means along a substantially continuous lower connection panel fold edge;

said lower panel means, bottom lower side panel means, first lower side panel means, connection panel means and said second lower side panel means being articulated so as to form the lower storage container cavity means;

upper panel means operably attached for articulation to the top of said connection panel means along a substantially continuous upper connection panel fold edge;

top upper side panel means operably attached for articulation to the top of said upper panel means along a substantially continuous top upper side panel fold edge;

first upper side panel means operably attached for articulation to a first side of said upper panel means along a substantially continuous first upper side panel fold edge;

second upper side panel means operably attached for articulation to a second side of said upper panel means along a substantially continuous second upper side panel fold edge;

said first upper side panel means being substantially opposite said second upper side panel means along said upper panel means;

top upper interlocking panel means operably attached for articulation to the top side of said top upper side panel means along substantially continuous top upper interlocking panel fold edge;

first upper interlocking panel means operably attached for articulation to the first side of said first upper side panel means along a substantialy continuous first upper interlocking panel fold edge;

second upper interlocking panel means operably attached for articulation to the second side of said second upper side panel means along a substantially continuous second upper interlocking panel fold edge;

said first upper interlocking panel means being substantially opposite said second upper interlocking panel means along said upper panel means;

one or more corner tab means operably attached at the first edge of said top upper side panel means and the second edge of said top upper side panel means for articulation and connection with adjacent upper side panel means to form rigid sides for an upper storage container cover as well as substantially sealing corners formed therebetween.

said top upper interlocking panel means, first upper interlocking panel means and second upper interlocking panel means being articulated into a position overlapping said top upper side panel means, first upper side panel means and second upper side panel means respectively, thereby being capable of accepting the interposition of said corner tab means so as to lock the articulated panels so as to form the upper storage container cover as a substantially rigid structure with substantially restrained downwardly projecting side panel members;

said upper storage container cover with said downwardly projecting side panel members covering in an overlying fashion the entirety of said lower storage container cavity means;

one or more contaminant barrier means operably interposed upon articulation between one or more of said bottom lower side panel means, first lower side panel means, connection panel means and said second lower side panel means for operably sealing the juxtaposed regions respectively created among same upon articulation of the bottom lower side panel means, first lower side panel means, connection panel means and said second lower side panel means so as to preclude the migration of dust dirt and other contaminants into said lower storage container cavity.

2. The invention according to claim 1 in which said upper storage container cover means is hinged about the top edge of said connection panel means so as to telescopically receive said lower storage container cavity means resulting in the formation of a substantially sealed storage container.

3. The storage container blank means defined by claim 1 including:

bottom lower edge panel means operably attached for articulation to the bottom of said bottom lower side panel means along a substantially continuous bottom lower edge panel fold edge;

first lower edge panel means operably attached for articulation to the first side of said first lower side panel means along a substantially continuous first lower edge panel fold edge;

second lower edge panel means operably attached for articulation to the second side of said second lower side panel means along a substantially continuous second lower edge panel fold edge;

said first lower edge panel means being substantially opposite said second lower edge panel means along said lower panel means;

bottom lower interlocking panel means operably attached for articulation to the bottom of said bottom lower edge panel means along a substantially continuous bottom lower interlocking panel fold edge;

first lower interlocking panel means operably attached for articulation to the first side of said first lower edge panel means along a substantially continuous first lower interlocking panel fold edge;

second lower interlocking panel means operably attached for articulation to the second side of said second lower edge panel means along substantially continuous second lower interlocking panel fold edge;

said first lower interlocking panel means being substantially opposite said second lower interlocking panel means along said lower panel means;

said bottom lower interlocking panel means, first lower interlocking panel means and second lower interlocking panel means being articulated into a position overlapping said bottom lower side panel means, first lower side panel means and second lower side panel means respectively, resulting in the formation of a space between corresponding lower interlocking panel means and lower side panel means, said space being measured by the width of the corresponding lower edge panel means, said lower edge panel means being substantially perpendicular to its corresponding lower interlocking panel means and lower side panel means as a result of the overlapping of the corresponding lower interlocking panel means and lower side panel means, said space being capable of accepting the interposition of said contaminant barrier means so as to lock the articulated panels of said lower storage container cavity together forming a substantially rigid structure while preserving the dust imperviousness character of said storage container means.

4. The storage container blank means defined by claim 1 further including:

top upper edge panel means operably attached for articulation to the top of said top upper side panel means along a substantially continuous top upper edge panel fold edge and to the bottom of said top upper interlocking panel means along a substantially continuous top upper interlocking panel fold edge;

first upper edge panel means operably attached for articulation to the first side of said first upper side panel means along a substantially continuous first upper edge panel fold edge and to the second side of said first upper interlocking panel means along a substantially continuous first upper interlocking panel fold edge;

second upper edge panel means operably attached for articulation to the second side of said second upper side panel means along a substantially continuous second upper edge panel fold edge and to the first side of said second upper interlocking panel means along a substantially continuous second upper interlocking panel fold edge;

said first upper edge panel means being substantially opposite said second upper edge panel means along said upper panel means;

said top upper interlocking panel means, first upper interlocking panel means and second upper interlocking panel means being articulated into a position overlapping said top upper side panel means, first upper side panel means and second upper side panel means respectively, resulting in the formation of a space between corresponding upper interlocking panel means and upper side panel means, said space being measured by the width of the corresponding upper edge panel means, said upper edge panel means being substantially perependicular to its corresponding upper interlocking panel means and upper side panel means as a result of the overlapping of the corresponding upper interlocking panel means and upper side panel means, said space being capable of accepting the interposition of said corner tab means so as to lock the articulated panels of said upper storage container cover together forming a substantially rigid structure.

5. The invention according to claim 1 in which each of one or more of said contaminant barrier means comprises:

a collapsible articulated flap member;

each of said flap members being diagnally scored to form a plurality of articulated angular sections, said scoring being on the interior surface of said lower storage container cavity only, with said scoring not penetrating through the material thus permitting easy articulation without providing an entry point where dust and other contaminants could otherwise enter into said storage container means;

said scoring permitting the contaminant barrier means to fold inward toward the interior of said storage container means as said lower side panel means and said connection panel means are raised into a position substantially perpendicular to the plane formed by said lower panel means;

said flap members being crushed to substantially one half the thickness of the material forming said upper and lower side panel means and said upper and lower interlocking panel means so as to permit facilitated interpositioning of the articulated angular sections of said contaminant barrier into the space formed by the overlap of corresponding lower side panel means and lower interlocking panel means;

said interpositioning forming a substantially sealed corner element between adjacent lower side panel means and connection panel means resulting in a continuous unbroken surface at said corner positions to in turn prevent the entry of dust and other contaminants.

6. The storage container blank means according to claim 3 including a plurality of adhesive stick-pad means one or more of which being operably attached to said bottom lower interlocking panel means, first lower interlocking panel means, second lower interlocking panel means, for the purpose of securing said interlocking panel means in an overlapped orientation to said bottom lower side panel means, first lower side panel means, second lower side panel means respectively, securing said collapsible articulated flap members between said lower interlocking panel means and lower side panel means.

7. The storage container blank means according to claim 4 including a plurality of adhesive stick-pad means one or more of which being operably attached to said, top upper interlocking panel means, first upper interlocking panel means and second upper interlocking panel means for the purpose of securing said interlocking panel means in an overlapped orientation to said top upper side panel means, first upper side panel means and second upper side panel means respectively, securing said corner tab means between said upper interlocking panel means and upper side panel means.

8. The storage container blank means according to claim 3 in which the first and second edges of said bottom lower interlocking panel means, and the upper and lower edges of said first and second lower interlocking panel means are notched to facilitate the interlocking of adjacent lower interlocking panel means in a manner which secures said collapsible articulated flap members interposed into the space formed by the overlap of said lower interlocking panel means and lower side panel means.

9. The storage container blank means defined by claim 4 in which the first and second edges of said top upper interlocking panel means and the upper and lower edges of said first and second upper interlocking panel means are notched to facilitate the interlocking of adjacent upper interlocking panel means in a manner which secures said corner tab means interposed into the space formed by the overlap of said upper interlocking panel means and upper side panel means.

10. The invention according to claim 1 in which said storage container means includes inspection insert means comprising:

insert panel means have a hole of such size and shape so as to permit visual inspection of the contents within said storage container means, said hole being sealed with a transparent material means affixed to said insert panel means preventing entry of dust and other contaminants;

bottom window panel side means operably attached for articulation to the bottom of said insert panel means along a substantially continuous bottom window panel side fold edge;

first window panel side means operably attached for articulation to the first side of said insert panel means along a substantially continuous first window panel side fold edge;

top window panel side means operably attached for articulation to the top side of said insert panel means along a substantially continuous top window panel side fold edge;

second window panel side means operably attached for articulation to the second side of said insert panel means along a substantially continuous second window panel fold edge;

said inspection insert means being telescopically received by the lower storage container cavity;

said inspection insert means including adhesive tape secured along the seam formed by the meeting of said lower edge panel means and the edges of said insert panel permitting the viewing the contents of said storage container means through said insert panel means while at the same time preserving the storage container means resistance to the entry of dust and other contaminants.

11. The invention according to claim 10 in which said transparent material means is affixed to the underside of said insert panel means by a continuous adhesive bead means to prevent the entry of dust and other contaminants into said storage container means.

12. The storage container blank means defined by claim 1 in which said lower panel means, bottom lower side panel means, first lower side panel means, connection panel means, second lower side panel means, upper panel means, first upper side panel means, top upper side panel means, second upper side panel means, contaminant barrier means, and said upper tab means are all formed from a single substantially continuous sheet of material with creases being impressed into the sheet where each panel means joins another to permit articulation of said panel means.

13. The invention according to claim 12 in which said storage container blank means is formed from a single substantially continuous sheet of corrugated type cardboard material.

* * * * *